US007686077B2

(12) United States Patent
Casey

(10) Patent No.: US 7,686,077 B2
(45) Date of Patent: Mar. 30, 2010

(54) METHODS AND APPARATUS FOR DETERMINING WELLBORE PARAMETERS

(76) Inventor: Danny M. Casey, 211 Stubblefield Lake Rd., Huntsville, TX (US) 77340

( * ) Notice: Subject to any disclaimer, the term of this patent is extended or adjusted under 35 U.S.C. 154(b) by 0 days.

(21) Appl. No.: 12/122,680

(22) Filed: May 17, 2008

(65) Prior Publication Data

US 2008/0217006 A1 Sep. 11, 2008

Related U.S. Application Data

(63) Continuation of application No. 10/992,060, filed on Nov. 18, 2004, now Pat. No. 7,373,976.

(51) Int. Cl.
*E21B 47/04* (2006.01)

(52) U.S. Cl. ..... 166/250.03; 166/373

(58) Field of Classification Search ..... 166/250.03, 166/373, 64

See application file for complete search history.

(56) References Cited

U.S. PATENT DOCUMENTS

| | | | | |
|---|---|---|---|---|
| 3,408,561 | A * | 10/1968 | Osborn et al. | 324/342 |
| 3,820,389 | A * | 6/1974 | Richter, Jr. et al. | 73/152.59 |
| 4,352,376 | A | 10/1982 | Norwood | |
| 4,408,676 | A | 10/1983 | McCoy | |
| 4,425,086 | A * | 1/1984 | Peterson et al. | 417/388 |
| 4,750,583 | A | 6/1988 | Wolf | |
| 4,793,178 | A | 12/1988 | Ahern et al. | |
| 4,921,048 | A | 5/1990 | Crow et al. | |
| 5,132,904 | A | 7/1992 | Lamp | |
| 5,146,991 | A | 9/1992 | Rogers, Jr. | |
| 5,154,078 | A * | 10/1992 | Codazzi | 73/152.22 |
| 5,834,710 | A | 11/1998 | Finnestad | |
| 6,209,637 | B1 | 4/2001 | Wells | |
| 6,241,014 | B1 | 6/2001 | Majek et al. | |
| 6,484,817 | B2 * | 11/2002 | Innes | 175/45 |
| 6,595,287 | B2 | 7/2003 | Fisher | |
| 6,634,426 | B2 | 10/2003 | McCoy et al. | |
| 6,725,916 | B2 | 4/2004 | Gray et al. | |
| 2002/0008634 | A1 * | 1/2002 | Innes | 340/854.3 |
| 2004/0163806 | A1 | 8/2004 | Hadley | |
| 2004/0256099 | A1 * | 12/2004 | Nguyen et al. | 166/249 |

* cited by examiner

*Primary Examiner*—Shane Bomar
(74) *Attorney, Agent, or Firm*—Henry L. Ehrlich; Winstead PC

(57) ABSTRACT

One embodiment of a system for determining a wellbore parameter includes a pulse generator positioned in fluid communication with a wellbore such that a fluid can flow from the wellbore through the pulse generator, wherein the pulse generator selectively releases the fluid to flow through the pulse generator causing pressure pulses in the wellbore; a receiver in operational connection with the wellbore, the receiver detecting the pressure pulses; and a controller in functional connection with the receiver, the controller determining a wellbore parameter from receipt of a signal from the receiver in response to the detected pressure pulses.

19 Claims, 4 Drawing Sheets

METHODS AND APPARATUS FOR DETERMINING WELLBORE PARAMETERS

RELATED APPLICATIONS

This application is a continuation of U.S. patent application Ser. No. 10/992,060, filed Nov. 18, 2004, now U.S. Pat. No. 7,373,976.

TECHNICAL FIELD

The present invention relates to well production and more specifically to determining wellbore parameters.

BACKGROUND

In the life of most wells the reservoir pressure decreases over time resulting in the failure of the well to produce fluids utilizing the formation pressure solely. As the formation pressure decreases, the well tends to fill up with liquids, such as oil and water, which inhibits the flow of gas into the wellbore and may prevent the production of liquids. It is common to remove this accumulation of liquid by artificial lift systems such as plunger lift, gas lift, pump lifting and surfactant lift wherein the liquid column is blown out of the well utilizing the reaction between surfactants and the liquid.

Common to these artificial lift systems is the necessity to control the production rate of the well to achieve economical production and increase profitability. It is common for the production cycle of a particular lift system to be estimated based on known well characteristics and then adjusted over time through trial and error. Prior art systems have been utilized to automate the control system such that incremental changes are automatically implemented in the production cycle until the lift system fails, and then the production cycle is readjusted to a point before failure. A need still exists for a method and system for obtaining wellbore parameters in real-time to optimize an artificial lift system in real-time.

SUMMARY

One embodiment of a system for determining a wellbore parameter includes a pulse generator positioned in fluid communication with a wellbore such that a fluid can flow from the wellbore through the pulse generator, wherein the pulse generator selectively releases the fluid to flow through the pulse generator causing pressure pulses in the wellbore; a receiver in operational connection with the wellbore, the receiver detecting the pressure pulses; and a controller in functional connection with the receiver, the controller determining a wellbore parameter from receipt of a signal from the receiver in response to the detected pressure pulses.

An embodiment of a method for determining a wellbore parameter includes the step of releasing a burst of fluid from the wellbore causing a pressure pulse in the wellbore; detecting the pressure pulse; and determining a wellbore parameter utilizing the detected pressure pulse.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
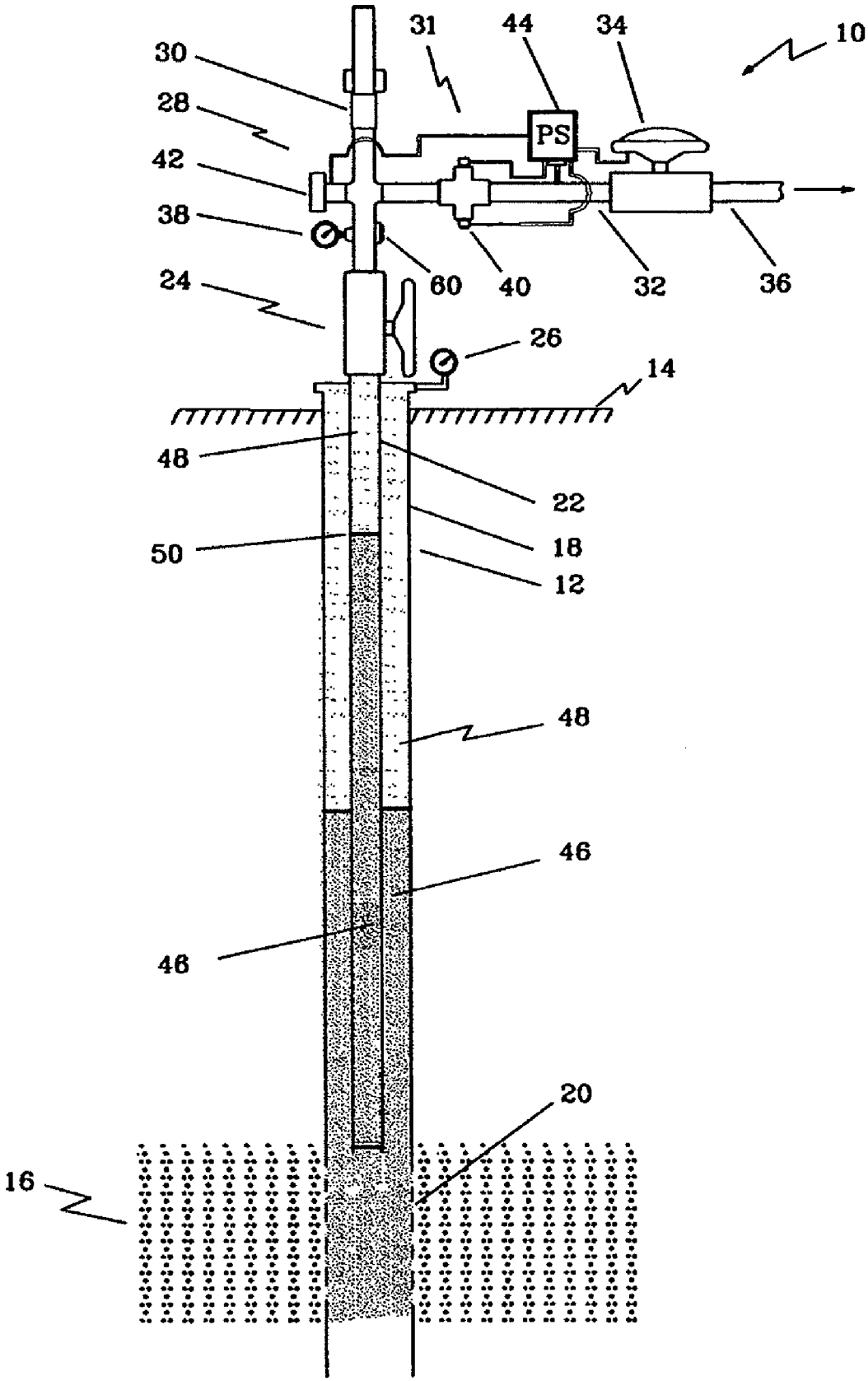
FIG. 1 is a schematic drawing of a well production optimizing system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

FIG. 1 is a schematic drawing of a well production optimizing system of the present invention, generally denoted by the numeral 10. The figure is illustrative of well under artificial lift production, which may include systems such as, but not limited to, gas lift, surfactant lift, beam pumping, and plunger lift. The well includes a wellbore 12 extending from the surface 14 of the earth to a producing formation 16. Wellbore 12 may be lined with a casing 18 including perforations 20 proximate producing formation 16. The surface end of casing 18 is closed at surface 14 by a wellhead generally denoted by the numeral 24. A casing pressure transducer 26 is mounted at wellhead 24 for monitoring the pressure within casing 18.

A tubing string 22 extends down casing 18. Tubing 22 is supported by wellhead 24 and in fluid connection with a production "T" 28. Production "T" 28 includes a lubricator 30 and a flow line 31 having a section 32, also referred to as the production line, upstream of a flow-control valve 34, and a section 36 downstream of flow-control valve 34. Downstream section 36, also referred to generally as the salesline, may lead to a separator, tank or directly to a salesline. Production "T" 28 typically further includes a tubing pressure transducer 38 for monitoring the pressure in tubing 22.

Wellbore 12 is filled with fluid from formation 16. The fluid includes liquid 46 and gas 48. The liquid surface at the liquid gas interface is identified as 50. With intermittent lift systems it is necessary to monitor and control the volume of liquid 46 accumulating in the well to maximize production.

Well production optimizing system 10 includes flow-control valve 34, a flow-interruption pulse generator 40, a receiver 42 and a controller 44. Flow-control valve 34 is positioned within flow line 31 and may be closed to shut-in wellbore 12, or opened to permit flow into salesline 36.

Flow-interruption pulse generator 40 is connected in flow line 31 so as to be in fluid connection with fluid in tubing 22. Although pulse generator 40 is shown connected within flow line 31 it should be understood that pulse generator 40 may be positioned in various locations such that it is in fluid connection with tubing 22 and the fluid in wellbore 12.

Pulse generator 40 is adapted to interrupt or affect the fluid within the tubing 22 in a manner to cause a pressure pulse to be transmitted down tubing 22 and to be reflected back upon contact with a surface. Pulse generator 40 is described in more detail below.

Receiver 42 is positioned in functional connection with tubing 22 so as to receive the pressure pulses created by pulse generator 40 and the reflected pressure pulses. Receiver 42 recognizes pressure pulses received and converts them to electrical signals that are transmitted to controller 44. The signal is digitized, and the digitized data is stored in controller 44.

Controller 44 is in operational connection with pulse generator 40, receiver 42 and flow-valve 34. Controller 44 may also be in operational connection with casing pressure transducer 26, tubing pressure transducer 38 and other valves (not shown). Controller 44 includes a central processing unit (CPU), such as a conventional microprocessor, and a number of other units interconnected via a system bus. The controller includes a random access memory (RAM) and a read only memory (ROM), and may include flash memory. Controller 44 may also include an I/O adapter for connecting peripheral devices such as disk units and tape drives to the bus, a user interface adapter for connecting a keyboard, a mouse and/or other user interface devices such as a touch screen device to the bus, a communication adapter for connecting the data processing system to a data processing network, and a display adapter for connecting the bus to a display device which may include sound. The CPU may include other circuitry not shown herein, which will include circuitry found within a microprocessor, e.g., an execution unit, a bus interface unit, an arithmetic logic unit (ALU), etc. The CPU may also reside on a single integrated circuit (IC).

Controller 44 may be located at the well or at a remote locations such as a field or central office. Controller 44 is functionally connected to flow-control valve 34, receiver 42, and pulse generator 40 via hard lines and/or telemetry. Data from receiver 42 may be received, stored and evaluated by controller 44 utilizing software stored on controller 44 or accessible via a network. Controller 44 sends signals for operation of pulse generator 40 and receives information regarding receipt of the pulse from pulse generator 40 via receiver 42 for storage and use. The data received by controller 44 is utilized by controller 44 to manipulate the production cycle, during the production cycle in real-time, to optimize production. Controller 44 may also be utilized to display real-time as well as historical production cycles in various formats as desired.

An example of the operation of optimizing system 10 is described with reference to FIG. 1 to determine the liquid level in tubing 22. Controller 44 sends a signal to pulse generator 40 to create a pressure pulse within tubing 22. Pulse generator 40 and its operation is disclosed in detail below. The pressure pulse travels down tubing 22 and is reflected back up tubing 22 upon encountering objects or surfaces such as liquid surface 50, plungers, collars, sub-surface formation and the like. Receiving unit 42, which is in fluid or sonic connection with pulse generator 40 and tubing 22 receives the pulse from pressure generator 40 and the reflected pressure pulses. The pulse received is converted to an electrical signal and transmitted to controller 44 for storage and use. This data received by controller 44 may be filtered and analyzed by the controller to determine well status information such as, but not limited to, the position of liquid surface 50, liquid volume in the well, and the change in liquid level 50 over time. Controller 44 may then utilize this information to operate flow-control valve 34 between the open and closed position as necessary.

Figure 2:
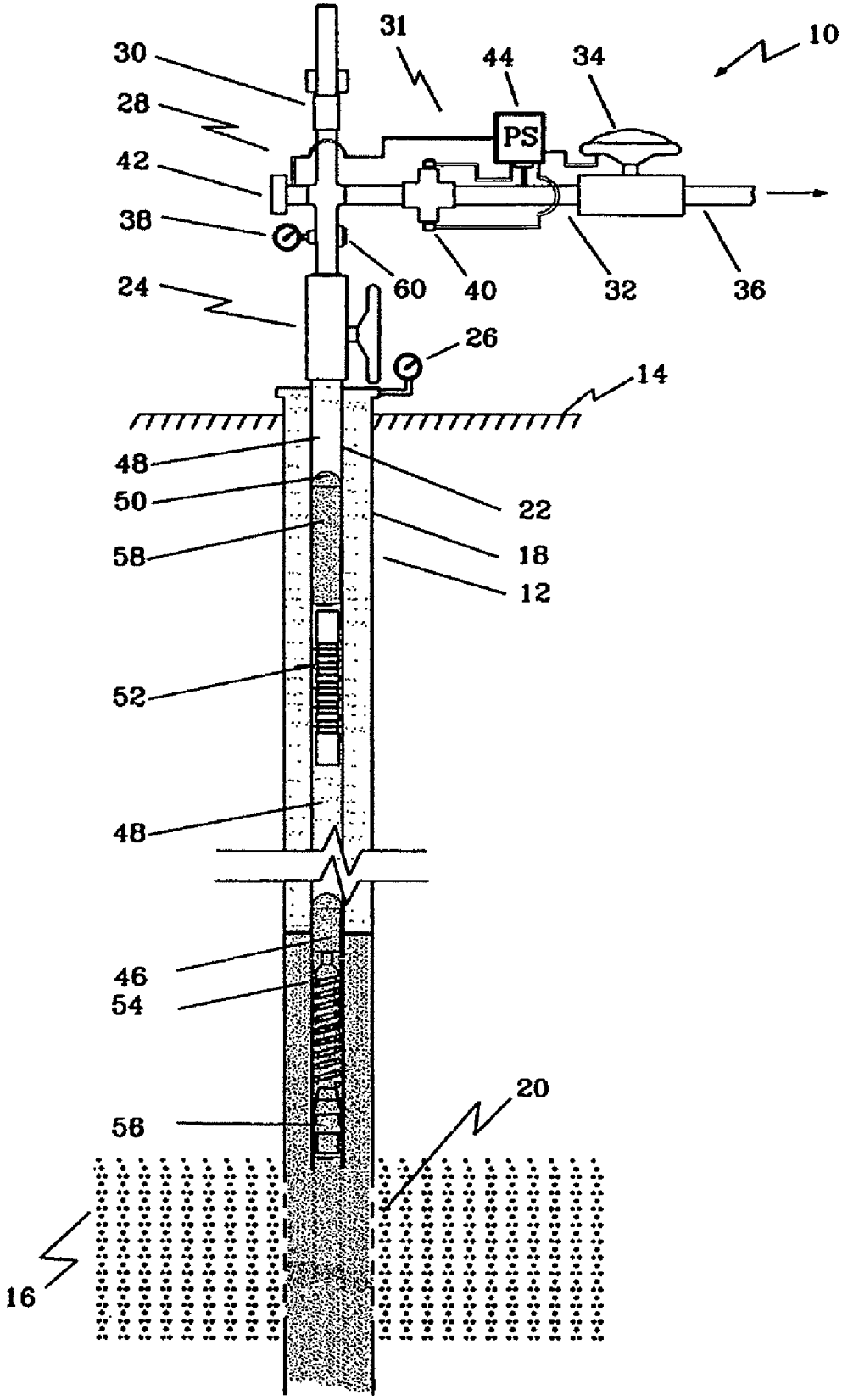
FIG. 2 is a schematic drawing of a well production optimizing system utilizing plunger lift.

FIG. 2 is a schematic drawing of a well production optimizing system 10 utilizing a plunger-lift system. The well includes a wellbore 12 extending from the surface 14 of the earth to a producing formation 16. Wellbore 12 may be lined with a casing 18 including perforations 20 proximate producing formation 16. The surface end of casing 18 is closed at surface 14 by a wellhead generally denoted by the numeral 24. A casing pressure transducer 26 is mounted at wellhead 24 for monitoring the pressure within casing 18.

A tubing string 22 extends down casing 18. Tubing 22 is supported by wellhead 24 and in fluid connection with a production "T" 28. Production "T" 28 includes a lubricator 30 and a flow line 31 having a section 32, also referred to as the production line, upstream of a flow-control valve 34, and a section 36 downstream of flow-control valve 34. Downstream section 36, also referred to as the salesline, may lead to a separator, tank or directly to a salesline. Production "T" 28 typically further includes a tubing pressure transducer 38 for monitoring the pressure in tubing 22.

A plunger 52 is located within tubing 22. A spring 54 is positioned at the lower end of tubing 22 to stop the downward travel of plunger 52. Fluid enters casing 18 through perforations 20 and into tubing 22 through standing valve 56. Lubricator 30 holds plunger 52 when it is driven upward by gas pressure. A liquid slug 58 is supported by plunger 52 and lifted to surface 14 by plunger 52.

Well production optimizing system 10 includes flow-control valve 34, a flow-interruption pulse generator 40, a receiver 42 and a controller 44. Flow-control valve 34 is positioned within flow line 31 and may be closed to shut-in wellbore 12, or opened to permit flow into salesline 36.

Plunger-lift systems are a low-cost, efficient method of increasing and optimizing production in wells that have marginal flow characteristics. The plunger provides a mechanical interface between the produced liquids and gas. The free-traveling plunger is lifted from the bottom of the well to the surface when the lifting gas energy below the plunger is greater than the liquid load and gas pressure above the plunger.

In a typical plunger-lift system operation, the well is shut-in by closing flow-control valve 34 for a pre-selected time period during which sufficient formation pressure is developed within casing 18 to move plunger 52, along with fluid collected in the well, to surface 34 when flow-control valve 34 is opened. This shut-in period is often referred to as "off time."

After passage of the selected "off-time" the production cycle is started by opening flow-control valve 34. As plunger 52 rises in response to the downhole casing pressure, fluid slug 58 is lifted and produced into salesline 36. In the prior art plunger-lift systems when plunger 52 reaches the lubricator its arrival is noted by arrival sensor 60 and a signal is sent to controller 44 to close flow-control valve 34 and end the cycle. It also may be desired to allow control-valve 34 to remain open for a pre-selected time to flow gas 48. The continued flow period after arrival of plunger 52 at lubricator 30 is referred to as "after-flow." Upon completion of a pre-selected after-flow period controller 44 sends a signal to flow-control valve 34 to close. Thereafter, plunger 52 falls through tubing 22 to spring 54. The production cycle then begins again with an off-time, ascent stage, after-flow, and descent stage.

Optimizing system 10 of the present invention permits the production cycle of the plunger-lift system to be monitored and controlled in real-time, during each production cycle, to optimize production from the well. Controller 44 may be initially set for pre-selected off-time and after-flow. To control and optimize the well production, controller 44 intermittently operates pulse generator 40 creating a pressure pulse that travels down tubing 22 and is reflected off of liquid surface 50 and plunger 52. The pressure pulse and reflections are received by receiver 42 and sent to controller 44 and stored as data. Controller 44 may receive further data such as casing pressure 26, tubing pressure 38 and flow rates into salesline 36. Additional, data such as well fluid compositions and characteristics may be maintained by controller 44. This cumulative data is monitored and analyzed by controller 44 to determine the status of the well. This status data may include data, such as, but not limited to liquid surface 50 level, fluid volume in the well, the rate of change of the level of liquid surface 50, the position of plunger 52 in tubing 22, the speed of travel of plunger 52, and the in-flow performance rate (IPR). The status data may then be utilized by controller 44 to alter the operation of the production system. This status data may also be utilized by controller 44 or an operator to determine the wear and age characteristics of plunger 22 for replacement or repair.

For example, during the off-time the well status data may indicate that the downhole pressure is sufficient to lift the accumulated liquid 46 to surface 14 before the pre-selected off-time has elapsed. Or that the liquid volume is accumulating to a degree to inhibit the operation of plunger 52. Controller 44 may then open flow-control valve 34 to initiate production.

In another example, as plunger 52 ascends in tubing 22, the well status data calculated and received by controller 44 may indicate that the rate of ascension is too fast and may result in damage to plunger 52 and/or lubricator 30. Controller 44 may then signal flow-control valve 34 to close or restrict flow through valve 34 thereby slowing or stopping the ascension of plunger 52.

In a further example, controller 44 may recognize that plunger 52 is ascending too slow, stalled or falling during the ascension stage. Controller 44 may then close flow-control valve 34 to terminate the trip, or further open flow-control valve 34 or open a tank valve to allow plunger 52 to rise to lubricator 30.

In a still further example, during after-flow the controller 44 well status data may indicate that liquid 46 is accumulating in tubing 22, therefore controller 44 can signal flow-control valve 44 to close and allow plunger 52 to descend to spring 54. Then a new production cycle may be initiated.

As can be determined by the examples of operation of optimizing system 10, an artificial lift system can be controlled in real-time in a manner not heretofore recognized. Although operation of optimizing system 10 of the present invention is disclosed with reference to a plunger-lift system in FIG. 2, optimizing system 10 is adapted for operation in any type of artificial or intermittent lift system including gas lift and surfactant lift.

Figure 3:
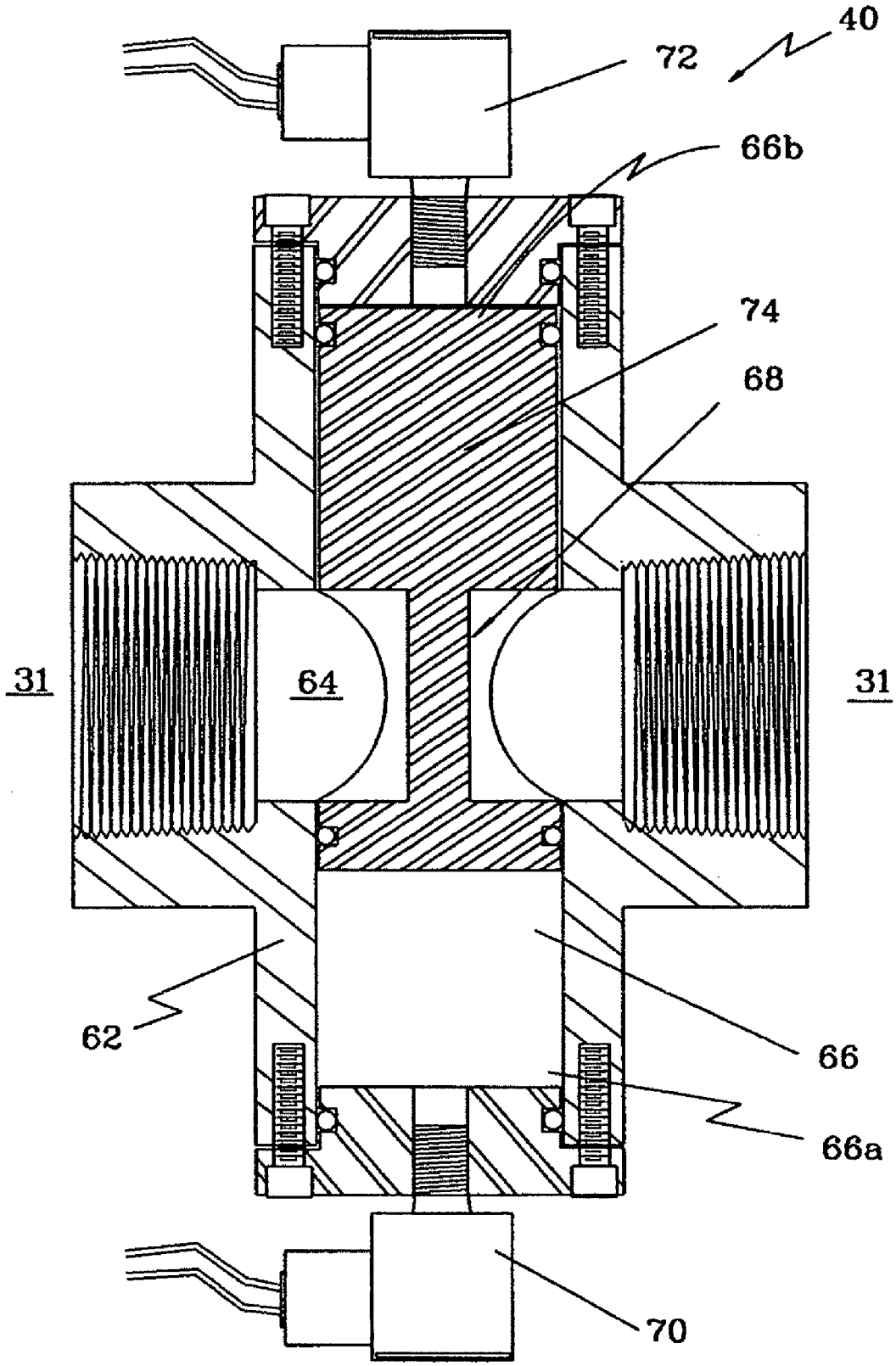
FIG. 3 is a partial cross-sectional view of a flow-interruption pulse generator of the present invention.

FIG. 3 is a partial cross-sectional view of a flow-interruption pulse generator 40 of the present invention. Pulse generator 40 includes a valve body 62 forming a fluid channel 64, a cross-bore 66 intersecting channel 64 and a piston 68. Electromagnetic solenoids 70 and 72 are connected to the first and second ends 66*a* and 66*b* of bore 66 respectively. Solenoids 70 and 72 are functionally connected to controller 44 (FIGS. 1 and 2) for selectively venting bore 66 and motivating movement of piston 68. Operation of solenoids 70 and 72 moves piston head 74 from the second end 66*b* of bore 66 into channel 64 and then back into bore 66.

Operation of pulse generator 40 to create a pressure pulse is described with reference to FIGS. 1 through 3. Pulse generator 40 is connected within flowline 31 through channel 64. Controller sends a signal to solenoid 70 to vent motivating piston 68 and moving piston head 74 into channel 64. Controller 44 then sends a signal to solenoid 72 to vent motivating piston 68 and moving piston head 74 from channel 64 and toward second bore end 66*b*. This fast acting movement of piston head 74 into flow channel 64 creates a pressure pulse that travels through the fluid in flowline 31 and tubing 22.

Figure 4:
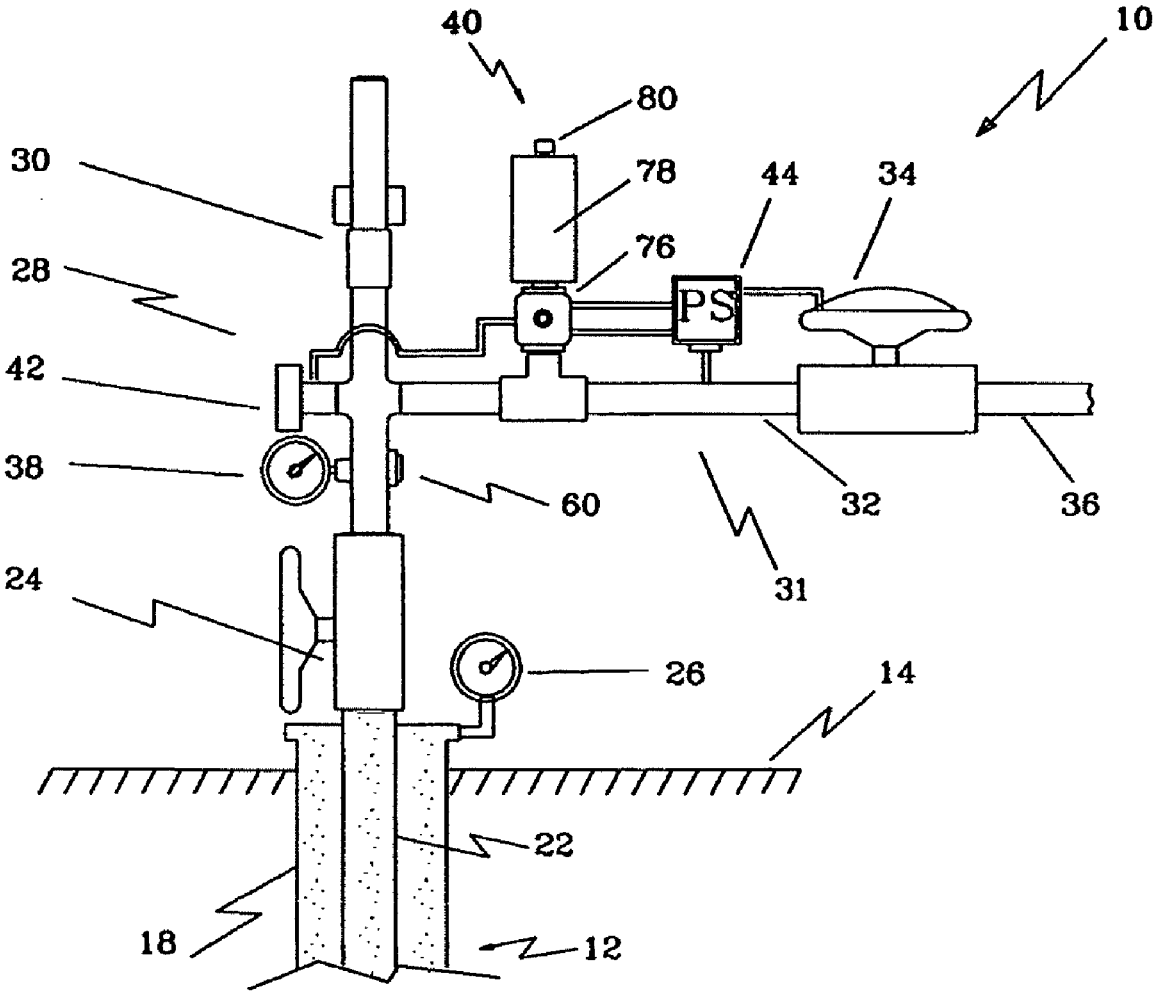
FIG. 4 is a view of another embodiment of a flow-interruption pulse generator of the present invention.

FIG. 4 is a view of another embodiment of a flow-interruption pulse generator 40 of the present invention. Pulse generator 40 includes a fast acting, motor driven valve 76 in fluid connection with flowline 31. Motor driven valve 76 is in operational connection with controller 44. To create a pressure pulse in flowline 31 and tubing 22, controller 44 substantially instantaneously opens and closes valve 76 releasing gas from flowline 31. Pulse generator 40 may include a vent chamber 78 connected to fast-acting valve 76. Vent chamber 78 may further include a bleed valve 80 to facilitate bleeding gas captured in vent chamber 78 to be discharged to the atmosphere.

From the foregoing detailed description of specific embodiments of the invention, it should be apparent that a method and apparatus for monitoring and optimizing an artificial lift system that is novel and unobvious has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A system for determining wellbore parameters, the system comprising:

a wellbore in communication with a producing formation;

a tubular string disposed in the wellbore providing a flow path for a fluid produced from the producing formation to the surface of the wellbore;

a pulse generator positioned at the surface in fluid communication with the tubular string such that the fluid flows from the producing formation through the pulse generator, wherein the pulse generator selectively releases the fluid to flow through the pulse generator causing pressure pulses in the wellbore;

a receiver in operational connection with the wellbore, the receiver detecting the pressure pulses; and a controller in functional connection with the receiver, the controller determining a wellbore parameter from receipt of a signal from the receiver in response to the detected pressure pulses.

2. The system of claim 1, wherein the pulse generator comprises a fast-acting valve substantially instantaneously operable between an open and closed position to release a burst of the fluid flowing from the producing formation.

3. The system of claim 2, further including a chamber in connection with the fast-acting valve to capture the burst of fluid.

4. The system of claim 1, the pulse generator comprises:

a valve body forming a fluid channel through which the fluid from the producing formation flows;

a cross-bore intersecting the channel; and a piston disposed in the cross-bore, the piston selectively positioned to permit the fluid to flow from the wellbore through the channel.

5. The system of claim 4, wherein the wellbore parameter is the level of the liquid in a portion of the wellbore.

6. The system of claim 4, wherein the controller activates the pulse generator to create the pressure pulse.

7. The system of claim 6, wherein the wellbore parameter is the level of the liquid in a portion of the wellbore.

8. The system of claim 1, wherein the wellbore parameter is the level of the liquid in a portion of the wellbore.

9. The system of claim 5, wherein the pulse generator comprises a fast-acting valve substantially instantaneously operable between an open and closed position to release a burst of the fluid flowing from the producing formation.

10. The system of claim 9, further including a chamber in connection with the fast-acting valve to capture the burst of fluid released from the producing formation.

11. The system of claim 1, wherein the controller activates the pulse generator to create the pressure pulse.

12. The system of claim 11, wherein the pulse generator comprises a fast-acting valve substantially instantaneously operable between an open and closed position to release a burst of the fluid flowing from the producing formation.

13. The system of claim 12, further including a chamber in connection with the fast-acting valve to capture the burst of fluid released.

14. A method for determining a wellbore parameter comprising the step of:

producing a fluid from a subterranean formation via a wellbore;

releasing a burst of the fluid flowing from the wellbore causing a pressure pulse in the wellbore, wherein releasing the burst of fluid comprises actuating a fast-acting valve substantially instantaneously between an open and closed position;

detecting the pressure pulse; and determining a wellbore parameter utilizing the detected pressure pulse.

15. The method of claim 14, further comprising capturing the burst of fluid released in an accumulator in fluid communication with the fast-acting valve.

16. A method for determining a wellbore parameter, comprising:

producing a fluid from a subterranean formation via a wellbore;

releasing a burst of the fluid flowing from the wellbore causing a pressure pulse in the wellbore, wherein releasing the burst of fluid comprises actuating a valve, the valve comprising a valve body forming a fluid channel through which the fluid from the wellbore can flow; a cross-bore intersecting the channel; and a piston disposed in the cross-bore, the piston selectively positioned to permit the fluid to flow from the wellbore through the channel detecting the pressure pulse; and determining a wellbore parameter utilizing the detected pressure pulse.

17. The method of claim 16, further including capturing the released burst of fluid in an accumulator in fluid communication with the valve.

18. A method for determining a wellbore parameter, comprising:

producing a fluid from a subterranean formation via a wellbore;

releasing a burst of the fluid flowing from the wellbore causing a pressure pulse in the wellbore;

detecting the pressure pulse; and determining a wellbore parameter utilizing the detected pressure pulse, wherein the wellbore parameter comprises the level of a liquid in a portion of the wellbore.

19. A method for determining a wellbore parameter, comprising:

producing a fluid from a subterranean formation via a wellbore;

releasing a burst of the fluid flowing from the wellbore causing a pressure pulse in the wellbore, wherein the burst of fluid is released from a tubing disposed in the wellbore;

detecting the pressure pulse; and determining a wellbore parameter utilizing the detected pressure pulse.

* * * * *